US011398175B2

(12) United States Patent
Lee et al.

(10) Patent No.: US 11,398,175 B2
(45) Date of Patent: Jul. 26, 2022

(54) DISPLAY APPARATUS AND DISPLAY SYSTEM HAVING THE SAME

(71) Applicant: Samsung Display Co., LTD., Yongin-si (KR)

(72) Inventors: Seung-Kyu Lee, Cheonan-si (KR); Beomjun Kim, Seoul (KR); Sang Seop Kum, Asan-si (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 0 days.

(21) Appl. No.: 17/469,249

(22) Filed: Sep. 8, 2021

(65) Prior Publication Data

US 2022/0114936 A1 Apr. 14, 2022

(30) Foreign Application Priority Data

Oct. 13, 2020 (KR) ..... 10-2020-0132226

(51) Int. Cl.
*G09G 3/20* (2006.01)

(52) U.S. Cl.
CPC ..... *G09G 3/20* (2013.01); *G09G 2300/026* (2013.01); *G09G 2300/0413* (2013.01); *G09G 2310/027* (2013.01); *G09G 2310/0267* (2013.01); *G09G 2310/061* (2013.01)

(58) Field of Classification Search
CPC ..... G09G 3/20; G09G 2300/0413; G09G 2310/0267; G09G 2310/0286; G09G 2310/027
See application file for complete search history.

(56) References Cited

U.S. PATENT DOCUMENTS

| | | | | |
|---|---|---|---|---|
| 10,607,968 | B2 | 3/2020 | Woo et al. | |
| 2012/0038616 | A1* | 2/2012 | Song | G09G 3/003 345/212 |
| 2017/0047018 | A1* | 2/2017 | Park | G09G 3/3266 |

FOREIGN PATENT DOCUMENTS

| | | |
|---|---|---|
| KR | 10-2050511 | 12/2019 |

* cited by examiner

*Primary Examiner* — Gerald Johnson
(74) *Attorney, Agent, or Firm* — Kile Park Reed & Houtteman PLLC

(57) ABSTRACT

A display apparatus includes a display panel, a data driver and a gate driving circuit. The display panel includes pixels, data lines, and gate lines. The data driver applies data voltages to the data lines. The data driver includes dummy stages. The gate driving circuit applies gate signals to the gate lines, and is disposed between opening portions in a display area of the display panel. The gate driving circuit includes normal stages that output the gate signals to the gate lines. The dummy stages output a reset signal to at least one of the normal stages.

20 Claims, 14 Drawing Sheets

DISPLAY APPARATUS AND DISPLAY SYSTEM HAVING THE SAME

CROSS-REFERENCE TO RELATED APPLICATION(S)

This application claims priority to and benefits of Korean Patent Application No. 10-2020-0132226 under 35 U.S.C. § 119, filed on Oct. 13, 2020 in the Korean Intellectual Property Office, the entire contents of which are incorporated herein by reference.

BACKGROUND

1. Technical Field

Embodiments relate to a display apparatus and a display system including the display apparatus. Embodiments relate to a display apparatus including a gate driving circuit disposed in a display area of a display panel and a display system including the display apparatus.

2. Description of the Related Art

Recently, interest in display apparatuses is increasing. Accordingly, various types of display apparatuses are manufactured in various types such as, for example, an organic light emitting diode ("OLED") display apparatus and a liquid crystal display ("LCD") apparatus.

Studies are being conducted to enlarge a display system. The enlarged display system may include a plurality of display panels. For example, the display system may include a tiled display system which combines a plurality of display apparatuses or panels to form one display system.

When a data driver is disposed on a first side of one display apparatus included in the tiled display system and a gate driver is disposed on a second side of the display apparatus included in the tiled display system perpendicular to the first side, a width of a dead space of the tiled display system may increase or a width of a seam line corresponding to an area where the display apparatuses may be connected may increase due to the data driver or the gate driver when forming the tiled display system.

It is to be understood that this background of the technology section is, in part, intended to provide useful background for understanding the technology. However, this background of the technology section may also include ideas, concepts, or recognitions that were not part of what was known or appreciated by those skilled in the pertinent art prior to a corresponding effective filing date of the subject matter disclosed herein.

SUMMARY

Embodiments provide a display apparatus including a gate driving circuit disposed in a display area of a display panel to reduce a width of a dead space of the display apparatus and to reduce a width of a dead space and a width of a seam line of a display system in which a plurality of display apparatuses are connected.

Embodiments also provide a display system including the display apparatus.

In an embodiment of a display apparatus, the display apparatus may include a display panel, a data driver and a gate driving circuit. The display panel may include a plurality of pixels, a plurality of data lines, and a plurality of gate lines. The data driver may apply a plurality of data voltages to the plurality of data lines. The data driver may include a plurality of dummy stages. The gate driving circuit may apply a plurality of gate signals to the plurality of gate lines, and may be disposed between opening portions in a display area of the display panel. The gate driving circuit may include a plurality of normal stages that output the plurality of gate signals to the plurality of gate lines. The plurality of dummy stages may output a reset signal to at least one of the plurality of normal stages.

In an embodiment, the data driver may be electrically connected to the display panel at a first side of the display panel.

In an embodiment, the plurality of normal stages may be scanned from a second side of the display panel to the first side of the display panel, and the first side and the second side of the display panel may be opposite to each other.

In an embodiment, one normal stage of the plurality of normal stages may output a gate signal of the plurality of gate signals to one pixel row. The one normal stage may be disposed at an area corresponding to a plurality of pixel columns.

In an embodiment, the gate driving circuit may include one normal stage column. One dummy stage column corresponding to the one normal stage column may be disposed in a data driving chip of the data driver. The normal stage column may include the plurality of normal stages. The one dummy stage column may include the plurality of dummy stages.

In an embodiment, the gate driving circuit may include a plurality of normal stage columns. A plurality of dummy stage columns corresponding to the plurality of normal stage columns may be disposed in a plurality of data driving chips of the data driver. The plurality of normal stage columns may include the plurality of normal stages. The plurality of dummy stage columns may include the plurality of dummy stages.

In an embodiment, a number of the plurality of dummy stage columns may be same as a number of the plurality of normal stage columns. A number of the plurality of data driving chips may be same as the number of the plurality of dummy stage columns.

In an embodiment of a display apparatus, the display apparatus may include a display panel, a data driver, a gate driving circuit and a printed circuit board. The display panel may include a plurality of pixels, a plurality of data lines, and a plurality of gate lines. The data driver may include a plurality of data driving chips that apply a plurality of data voltages to the plurality of data lines. The gate driving circuit may apply a plurality of gate signals to the plurality of gate lines. The gate driving circuit may be disposed between opening portions in a display area of the display panel. The printed circuit board may be electrically connected to the plurality of data driving chips, the printed circuit board may include a plurality of dummy stages. The gate driving circuit may include a plurality of normal stages that output the plurality of gate signals to the plurality of gate lines. The plurality of dummy stages may output a reset signal to at least one of the plurality of normal stages.

In an embodiment, the plurality of data driving chips may be electrically connected to the display panel at a first side of the display panel. The plurality of normal stages may be scanned from a second side of the display panel to the first side of the display panel, and the first side and the second side of the display panel may be opposite to each other.

In an embodiment, the gate driving circuit may include a plurality of normal stage columns. A plurality of dummy stage columns corresponding to the plurality of normal stage columns may be disposed on the printed circuit board. The plurality of normal stage columns may include the plurality of normal stages. The plurality of dummy stage columns may include the plurality of dummy stages.

In an embodiment, a number of the plurality of dummy stage columns may be same as a number of the plurality of normal stage columns.

In an embodiment, the gate driving circuit may include a plurality of normal stage columns. One dummy stage column may output the reset signal to the plurality of normal stage columns and may be disposed on the printed circuit board.

In an embodiment, the one dummy stage column may receive a carry signal from one normal stage column of the plurality of normal stage columns. The one dummy stage column may output the reset signal to the plurality of normal stage columns.

In an embodiment of a display apparatus, the display apparatus may include a display panel, a data driver, a gate driving circuit, a driving controller, a printed circuit board and a control board. The display panel may include a plurality of pixels, a plurality of data lines, and a plurality of gate lines. The data driver may include a plurality of data driving chips that apply a plurality of data voltages to the plurality of data lines. The gate driving circuit may apply a plurality of gate signals to the plurality of gate lines. The gate driving circuit may be disposed between opening portions in a display area of the display panel. The driving controller may output a control signal to the data driver and the gate driving circuit. The printed circuit board may be electrically connected to the plurality of data driving chips. The control board may be electrically connected to the printed circuit board, the control board including a plurality of dummy stages. The driving controller may be disposed on the control board. The gate driving circuit may include a plurality of normal stages that output the plurality of gate signals to the plurality of gate lines. The plurality of dummy stages may output a reset signal to at least one of the plurality of normal stages.

In an embodiment, the plurality of data driving chips may be electrically connected to the display panel at a first side of the display panel. The plurality of normal stages may be scanned from a second side of the display panel to the first side of the display panel, and the first side and the second side of the display panel may be opposite to each other.

In an embodiment, the gate driving circuit may include a plurality of normal stage columns. A plurality of dummy stage columns corresponding to the plurality of normal stage columns may be disposed on the control board. The plurality of normal stage columns may include the plurality of normal stages. The plurality of dummy stage columns may include the plurality of dummy stages.

In an embodiment, a number of the plurality of dummy stage columns may be same as a number of the plurality of normal stage columns.

In an embodiment, the gate driving circuit may include a plurality of normal stage columns. One dummy stage column may output the reset signal to the plurality of normal stage columns and may be disposed on the control board.

In an embodiment, the one dummy stage column may receive a carry signal from one normal stage column of the plurality of normal stage columns. The one dummy stage column may output the reset signal to the plurality of normal stage columns.

In an embodiment of a display system, the display system may include a plurality of display apparatuses connected to each other. Each of the plurality of display apparatuses may include a display panel, a data driver and a gate driving circuit. The display panel may include a plurality of pixels, a plurality of data lines, and a plurality of gate lines. The data driver may apply a plurality of data voltages to the plurality of data lines, the data driver may include a plurality of dummy stages. The gate driving circuit may apply a plurality of gate signals to the plurality of gate lines, and may be disposed between opening portions in a display area of the display panel. The gate driving circuit may include a plurality of normal stages that output the plurality of gate signals to the plurality of gate lines. The plurality of dummy stages may output a reset signal to at least one of the plurality of normal stages.

According to the display apparatus and the display system including the display apparatus, the normal stages of the gate driving circuit may be disposed in the display area of the display panel and the dummy stages outputting the reset signals to the normal stages may be disposed in the data driver, on the printed circuit board or on the control board so that the dead space of the display apparatus may be reduced.

The width of the seam line corresponding to an area in which the plural display apparatuses are connected may be reduced so that the display quality of the display system may be enhanced.

BRIEF DESCRIPTION OF THE DRAWINGS

The above and other features and advantages will become more apparent by describing in detail embodiments thereof with reference to the accompanying drawings, in which.

DETAILED DESCRIPTION OF THE EMBODIMENTS

Figure 1:
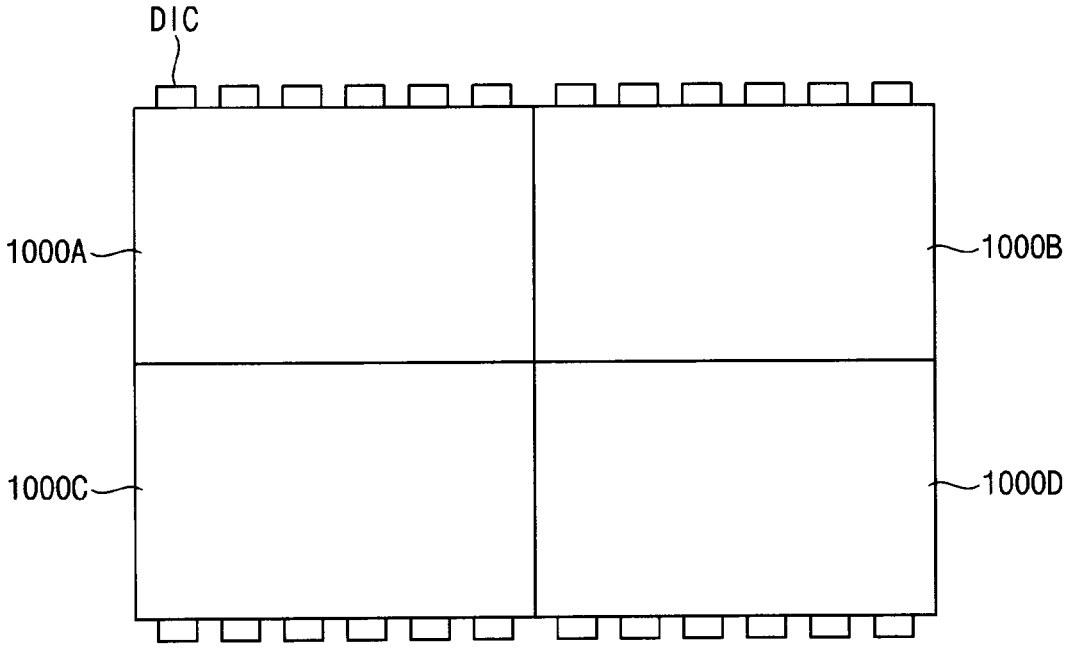
FIG. 1 is a block diagram illustrating a display system according to an embodiment.

Hereinafter, the disclosure will be explained in detail with reference to the accompanying drawings.

This disclosure may, however, be embodied in different forms and should not be construed as limited to the embodiments set forth herein. Rather, these embodiments are provided so that this disclosure will be thorough and complete, and will fully convey the scope of the disclosure to those skilled in the art.

In the drawings, sizes, thicknesses, ratios, and dimensions of the elements may be exaggerated for ease of description and for clarity. Like numbers refer to like elements throughout.

As used herein, the singular forms, "a," "an," and "the" are intended to include the plural forms as well, unless the context clearly indicates otherwise.

In the specification and the claims, the term "and/or" is intended to include any combination of the terms "and" and "or" for the purpose of its meaning and interpretation. For example, "A and/or B" may be understood to mean "A, B, or A and B." The terms "and" and "or" may be used in the conjunctive or disjunctive sense and may be understood to be equivalent to "and/or."

In the specification and the claims, the phrase "at least one of" is intended to include the meaning of "at least one selected from the group of" for the purpose of its meaning and interpretation. For example, "at least one of A and B" may be understood to mean "A, B, or A and B."

It will be understood that, although the terms first, second, etc., may be used herein to describe various elements, these elements should not be limited by these terms. These terms are only used to distinguish one element from another element. For example, a first element may be referred to as a second element, and similarly, a second element may be referred to as a first element without departing from the scope of the disclosure.

The spatially relative terms "below", "beneath", "lower", "above", "upper", or the like, may be used herein for ease of description to describe the relations between one element or component and another element or component as illustrated in the drawings. It will be understood that the spatially relative terms are intended to encompass different orientations of the device in use or operation, in addition to the orientation depicted in the drawings. For example, in the case where a device illustrated in the drawing is turned over, the device positioned "below" or "beneath" another device may be placed "above" another device. Accordingly, the illustrative term "below" may include both the lower and upper positions. The device may also be oriented in other directions and thus the spatially relative terms may be interpreted differently depending on the orientations.

The terms "comprises," "comprising," "includes," and/or "including,", "has," "have," and/or "having," and variations thereof when used in this specification, specify the presence of stated features, integers, steps, operations, elements, components, and/or groups thereof, but do not preclude the presence or addition of one or more other features, integers, steps, operations, elements, components, and/or groups thereof.

The phrase "in a plan view" means viewing the object from the top, and the phrase "in a schematic cross-sectional view" means viewing a cross-section of which the object is vertically cut from the side.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" may mean within one or more standard deviations, or within ±30%, 20%, 10%, 5% of the stated value.

Unless otherwise defined, all terms (including technical and scientific terms) used herein have the same meaning as commonly understood by one of ordinary skill in the art to which the disclosure pertains. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

It will be understood that when an element (or a region, a layer, a portion, or the like) is referred to as "being on", "connected to" or "coupled to" another element in the specification, it can be directly disposed on, connected or coupled to another element mentioned above, or intervening elements may be disposed therebetween.

It will be understood that the terms "connected to" or "coupled to" may include a physical or electrical connection or coupling.

Figure 2:
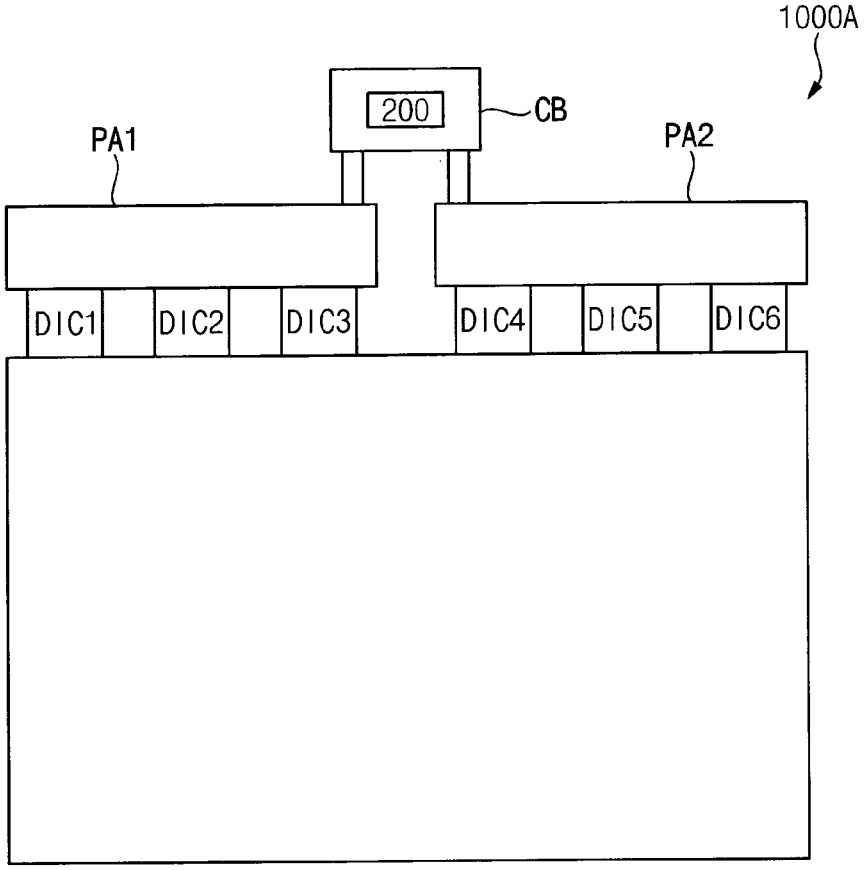
FIG. 2 is a diagram illustrating a first display apparatus of FIG. 1.
Figure 3:
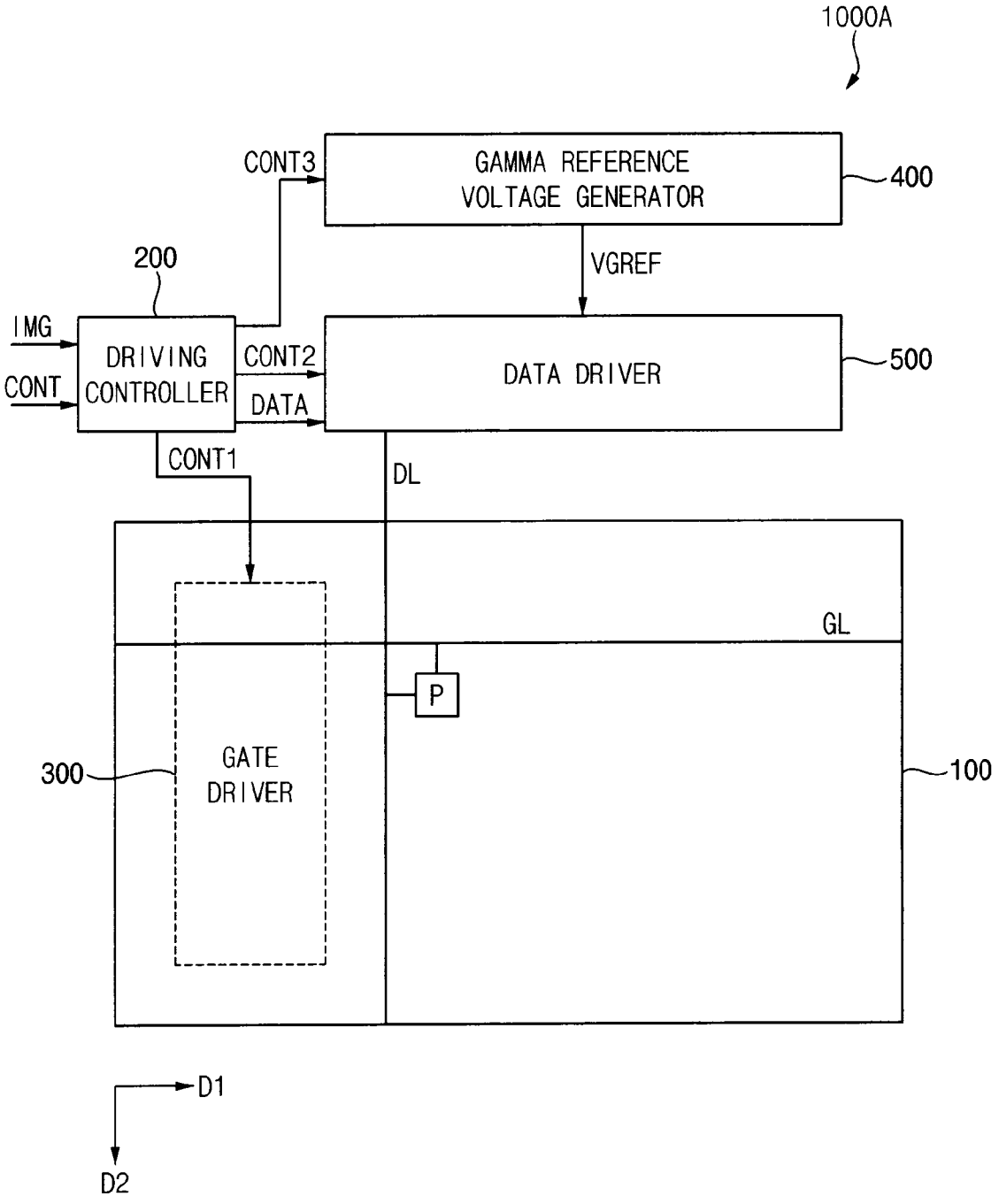
FIG. 3 is a block diagram illustrating the first display apparatus of FIG. 1.

FIG. 1 is a block diagram illustrating a display system according to an embodiment. FIG. 2 is a diagram illustrating a first display apparatus 1000A of FIG. 1. FIG. 3 is a block diagram illustrating the first display apparatus 1000A of FIG. 1.

Referring to FIGS. 1 and 2, the display system may include a plurality of display apparatuses 1000A, 1000B, 1000C and 1000D connected to each other. In an embodiment, the display system may include four display apparatuses 1000A, 1000B, 1000C and 1000D disposed in two rows and two columns. The four display apparatuses 1000A, 1000B, 1000C and 1000D may form a large sized television.

Although the display system may include four display apparatuses 1000A, 1000B, 1000C and 1000D disposed in two rows and two columns in an embodiment for convenience of explanation, the disclosure is not limited thereto. For example, the display system may include four display apparatuses disposed in one row and four columns. For example, the display system may include nine display apparatuses disposed in three rows and three columns.

Each of the display apparatuses 1000A, 1000B, 1000C and 1000D may include a display panel 100 displaying an image and including a plurality of pixels P, a data driver 500 applying a data voltage to a data line of the display panel 100 and a gate driver 300 applying a gate signal to a gate line GL of the display panel 100. The gate driver 300 may be disposed between opening portions in the display area of the display panel 100. In an embodiment, the gate driver 300 may be also referred as a gate driving circuit.

For example, the data driver 500 of the display apparatus (for example, 1000A, 1000B, 1000C and 1000D) may include a plurality of data driving chips DIC. Although each of the display apparatus may include six data driving chips DIC in FIG. 1, the disclosure is not limited to the number of the data driving chips DIC.

A data driver 500 (DIC) of a first display apparatus 1000A disposed in a first row and a first column among the four display apparatuses 1000A, 1000B, 1000C and 1000D may be disposed at an upper side of the first display apparatus 1000A. A data driver 500 (DIC) of a second display apparatus 1000B disposed in the first row and a second column among the four display apparatuses 1000A, 1000B, 1000C and 1000D may be disposed at an upper side of the second display apparatus 1000B. A data driver 500 (DIC) of a third display apparatus 1000C disposed in a second row and the first column among the four display apparatuses 1000A, 1000B, 1000C and 1000D may be disposed at a lower side of the third display apparatus 1000C. A data driver 500 (DIC) of a fourth display apparatus 1000D disposed in the second row and the second column among the four display apparatuses 1000A, 1000B, 1000C and 1000D may be disposed at a lower side of the fourth display apparatus 1000D.

By way of example, the data driver 500 (DIC) may be electrically connected to the display panel through a hole formed at the display panel so that the data driver 500 (DIC) may be disposed on a rear surface of the display panel.

The display apparatus (for example, 1000A, 1000B, 1000C and 1000D) may include a driving controller 200 outputting control signals to the data driver 500 and the gate driver 300.

The display apparatus (for example, 1000A, 1000B, 1000C and 1000D) may include a printed circuit board PA1 and PA2 electrically connected to the data driving chips DIC1, DIC2, DIC3, DIC4, DIC5 and DIC6 and a control board CB electrically connected to the printed circuit board PA1 and PA2. The driving controller 200 may be disposed on the control board CB.

For example, the display apparatus (for example, 1000A) may include a first printed circuit board PA1 and a second printed circuit board PA2. First to third data driving chips DIC1, DIC2 and DIC3 may be electrically connected between the first printed circuit board PA1 and the display panel 100. Fourth to sixth data driving chips DIC4, DIC5 and DIC6 may be electrically connected between the second printed circuit board PA2 and the display panel 100.

Referring to FIG. 3, the display apparatus (for example, 1000A) may include a display panel 100 and a display panel driver. The display panel driver may include a driving controller 200, a gate driver 300, a gamma reference voltage generator 400 and a data driver 500.

The display panel 100 has a display region on which an image or images is/are displayed and a peripheral region surrounding or adjacent to the display region.

The display panel 100 may include a plurality of gate lines GL, a plurality of data lines DL and a plurality of pixels P electrically connected to the gate lines GL and the data lines DL. The gate lines GL may extend in a first direction D1 and the data lines DL extend in a second direction D2 crossing or intersecting the first direction D1.

For example, the display panel 100 may be a nano light emitting diode display panel including a nano light emitting diode. For example, the display panel 100 may be a quantum-dot organic light emitting diode display panel including an organic light emitting diode and a quantum-dot color filter. For example, the display panel 100 may be an organic light emitting diode display panel including an organic light emitting diode. For example, the display panel 100 may be a liquid crystal display panel including a liquid crystal layer.

The driving controller 200 receives input image data IMG and an input control signal CONT from an external apparatus. The input image data IMG may include red image data, green image data and blue image data. The input image data IMG may include white image data. The input image data IMG may include magenta image data, yellow image data and cyan image data. The input control signal CONT may include a master clock signal and a data enable signal. The input control signal CONT may include a vertical synchronizing signal and a horizontal synchronizing signal.

The driving controller 200 generates a first control signal CONT1, a second control signal CONT2, a third control signal CONT3 and a data signal DATA based on the input image data IMG and the input control signal CONT.

The driving controller 200 generates the first control signal CONT1 for controlling an operation of the gate driver 300 based on the input control signal CONT, and outputs the first control signal CONT1 to the gate driver 300. The first control signal CONT1 may further include a vertical start signal and a gate clock signal.

The driving controller 200 generates the second control signal CONT2 for controlling an operation of the data driver 500 based on the input control signal CONT, and outputs the second control signal CONT2 to the data driver 500. The second control signal CONT2 may include a horizontal start signal and a load signal.

The driving controller 200 generates the data signal DATA based on the input image data IMG. The driving controller 200 outputs the data signal DATA to the data driver 500.

The driving controller 200 generates the third control signal CONT3 for controlling an operation of the gamma reference voltage generator 400 based on the input control signal CONT, and outputs the third control signal CONT3 to the gamma reference voltage generator 400.

The gate driver 300 generates gate signals driving the gate lines GL in response to the first control signal CONT1 received from the driving controller 200. The gate driver 300 sequentially outputs the gate signals to the gate lines GL.

In an embodiment, the gate driver 300 may be integrated in a display area of the display panel 100. The gate driver 300 may be disposed between the pixels P of the display panel 100.

The gamma reference voltage generator 400 generates a gamma reference voltage VGREF in response to the third control signal CONT3 received from the driving controller 200. The gamma reference voltage generator 400 provides the gamma reference voltage VGREF to the data driver 500. The gamma reference voltage VGREF has a value corresponding to a level of the data signal DATA.

In an embodiment, the gamma reference voltage generator 400 may be disposed in the driving controller 200, or in the data driver 500.

The data driver 500 receives the second control signal CONT2 and the data signal DATA from the driving controller 200, and receives the gamma reference voltage VGREF from the gamma reference voltage generator 400. The data driver 500 converts the data signal DATA into data voltages having an analog type using the gamma reference voltage VGREF. The data driver 500 outputs the data voltages to the data lines DL.

In an embodiment, the driving controller 200, the gamma reference voltage generator 400 and the data driver 500 may be integral with each other. For example, the driving controller 200, the gamma reference voltage generator 400 and the data driver 500 may be formed as a single chip.

Figure 4:
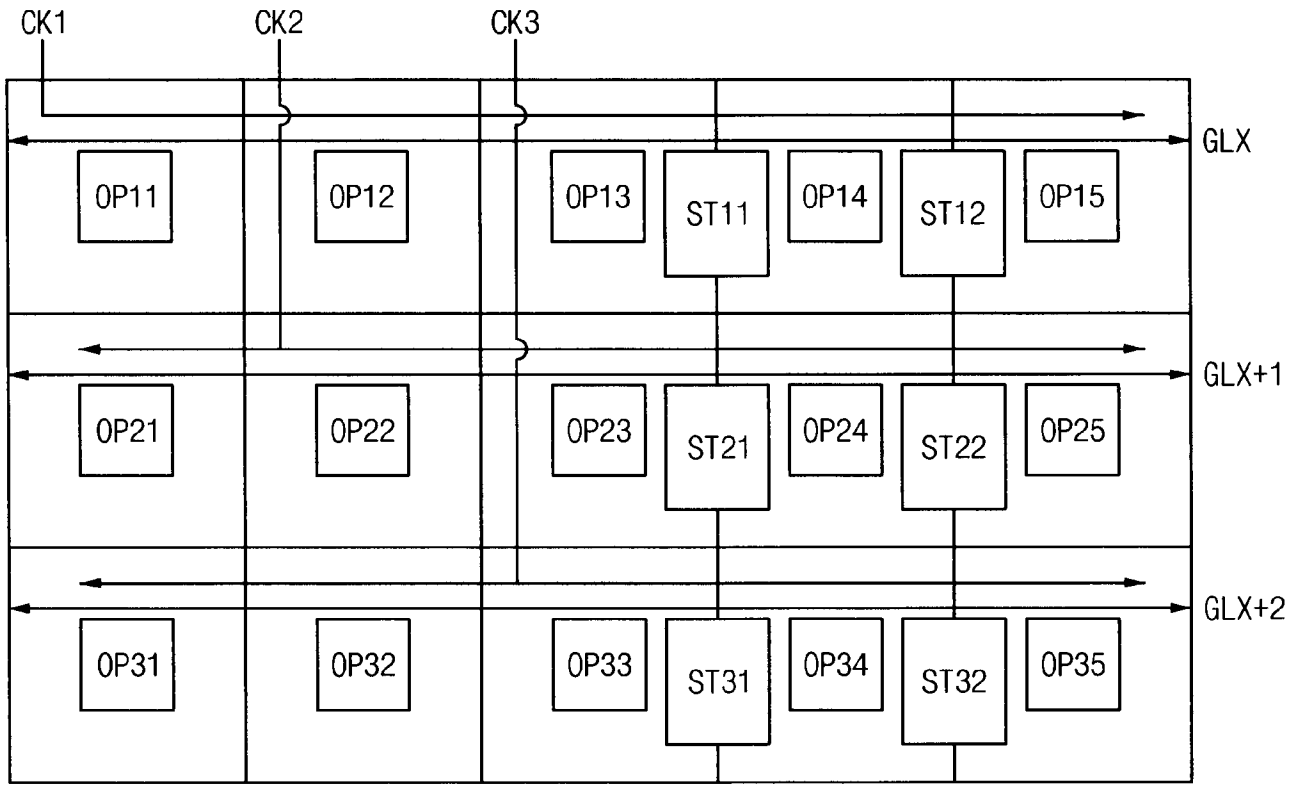
FIG. 4 is a diagram illustrating a portion of a display panel of FIG. 3.
Figure 5:
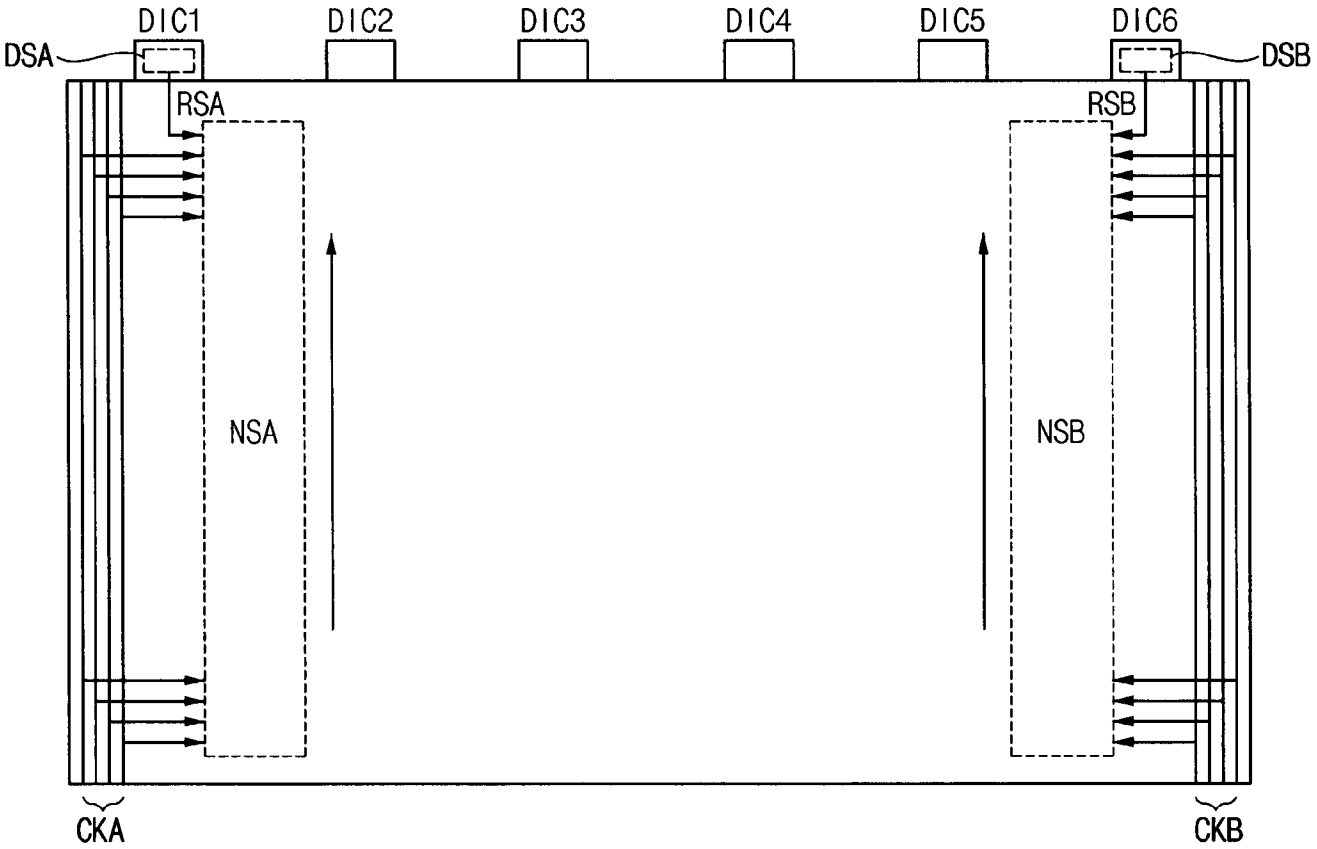
FIG. 5 is a plan view illustrating a normal stage column disposed in the display panel of FIG. 3 and a dummy stage column disposed in a data driver of FIG. 3.
Figure 6:
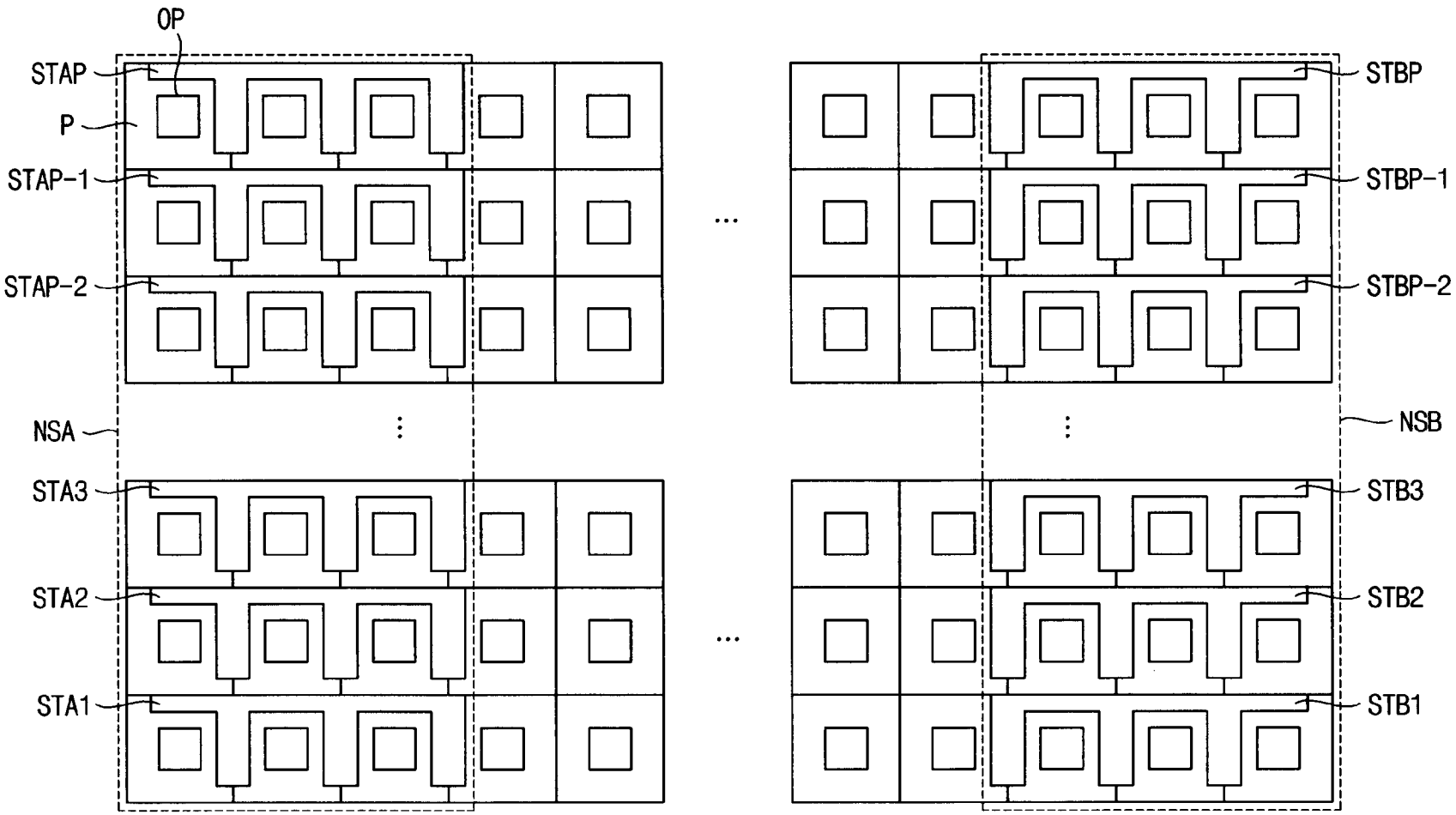
FIG. 6 is a plan view illustrating a structure of the normal stage column disposed in the display panel of FIG. 3.

FIG. 4 is a diagram illustrating a portion of the display panel 100 of FIG. 3. FIG. 5 is a plan view illustrating a normal stage column NSA and NSB disposed in the display panel 100 of FIG. 3 and a dummy stage column DSA and DSB disposed in the data driver 500 of FIG. 3. FIG. 6 is a plan view illustrating a structure of the normal stage column NSA and NSB disposed in the display panel 100 of FIG. 3.

Referring to FIGS. 1 to 6, the gate driving circuit 300 may be disposed between opening portions OP (for example, OP11 to OP35) in the display area of the display panel 100.

For example, the gate driving circuit 300 may include the normal stage column NSA and NSB extending in a pixel column direction D2 of the display panel 100 and including a plurality of normal stages.

A single normal stage may apply the gate signal to a single pixel row. The single normal stage may be disposed at an area corresponding to a plurality of pixel columns. As shown in FIG. 4, an X-th normal stage applying gate output signal to an X-th gate line GLX may include a first circuit portion (corresponding to ST11) and a second circuit portion (corresponding to ST12). An X+1-th normal stage applying gate output signal to an X+1-th gate line GLX+1 may include a third circuit portion (corresponding to ST21) and a fourth circuit portion (corresponding to ST22). An X+2-th normal stage applying gate output signal to an X+2-th gate line GLX+2 may include a fifth circuit portion (corresponding to ST31) and a sixth circuit portion (corresponding to ST32).

In FIG. 4, for example, the X-th normal stage may be disposed at a first circuit area ST11 and a second circuit area ST12 corresponding to at least two pixel columns, the X+1-th normal stage may be disposed at a third circuit area ST21 and a fourth circuit area ST22 corresponding to at least two pixel columns and the X+2-th normal stage may be disposed at a fifth circuit area ST31 and a sixth circuit area ST32 corresponding to at least two pixel columns. In an embodiment, one normal stage may be disposed at an area corresponding to the plurality of the pixel columns. Although one normal stage is illustrated to be disposed at the area corresponding to two pixel columns or three pixel columns in FIGS. 4 and 6 for convenience of explanation, the disclosure is not limited thereto. For example, one normal stage may be disposed at an area corresponding to ten or more pixel columns.

The normal stage may include a plurality of transistors. A first group of the transistors disposed at the first circuit area ST11 may be disposed between an M-th pixel column (for example, a third pixel column OP13, OP23 and OP33 of FIG. 4) and an M+1-th pixel column (for example, a fourth pixel column OP14, OP24 and OP34 of FIG. 3). A pixel column may refer to a column of the openings, for example, openings aligned in a same column. A second group of the transistors disposed at the second circuit area ST12 may be disposed between the M+1-th pixel column (for example, the fourth pixel column OP14, OP24 and OP34 of FIG. 4) and an M+2-th pixel column (for example, a fifth pixel column OP15, OP25 and OP35 of FIG. 4). FIG. 4 also illustrates a first pixel column, OP11, OP21 and OP31 and a second pixel column, OP12, OP22 and OP32.

In an embodiment, a plurality of dummy stages may be disposed in the data driver 500. The dummy stage may output a reset signal RSA and RSB to at least one of the normal stages.

For example, the gate driving circuit 300 may include the normal stage columns NSA and NSB. The dummy stage columns DSA and DSB corresponding to the normal stage columns NSA and NSB may be disposed in the data driving chips (for example, DIC1 and DIC6) of the data driver 500. The normal stage column may include the normal stages. The dummy stage column may include the dummy stages.

In an embodiment, the number (for example, two) of the dummy stage columns may be same as the number (for example, two) of the normal stage columns. The number of the data driving chips (for example, six) may be greater than the number (for example, two) of the dummy stage columns.

For example, in FIGS. 5 and 6, a first normal stage column NSA may be disposed in a first edge portion of the display panel 100 and a second normal stage column NSB may be disposed in a second edge portion of the display panel 100 opposite to the first edge portion. For example, in FIGS. 5 and 6, a first dummy stage column DSA corresponding to the first normal stage column NSA may be disposed in the first data driving chip DIC1 and a second dummy stage column DSB corresponding to the second normal stage column NSB may be disposed in the sixth data driving chip DIC6.

The first normal stage column DSA may include a plurality of normal stages STA1, STA2, STA3, . . . , STAP-2, STAP-1 and STAR The second normal stage column DSB may include a plurality of normal stages STB1, STB2, STB3, . . . , STBP-5, STBP-4, STBP-3, STBP-2, STBP-1 and STBP. The first dummy stage column DSA may include a plurality of dummy stages outputting a reset signal RSA to at least one of the normal stages of the first normal stage column NSA. The second dummy stage column DSB may include a plurality of dummy stages outputting a reset signal RSB to at least one of the normal stages of the second normal stage column NSB. For example, the dummy stages may not output the gate signal to the gate lines.

The first normal stage column NSA may receive gate clock signals through a first clock line group CKA. The second normal stage column NSB may receive gate clock signals through a second clock line group CKB.

In an embodiment, the data driving chips DIC1 to DIC6 of the data driver 500 may be electrically connected to the display panel 100 at a first side of the display panel 100. The normal stages may be scanned from a second side of the display panel 100, which is opposite to the first side of the display panel 100, to the first side of the display panel 100. Accordingly, the dummy stages may easily output the reset signal to the normal stages adjacent to the first side of the display panel 100.

Figure 7:
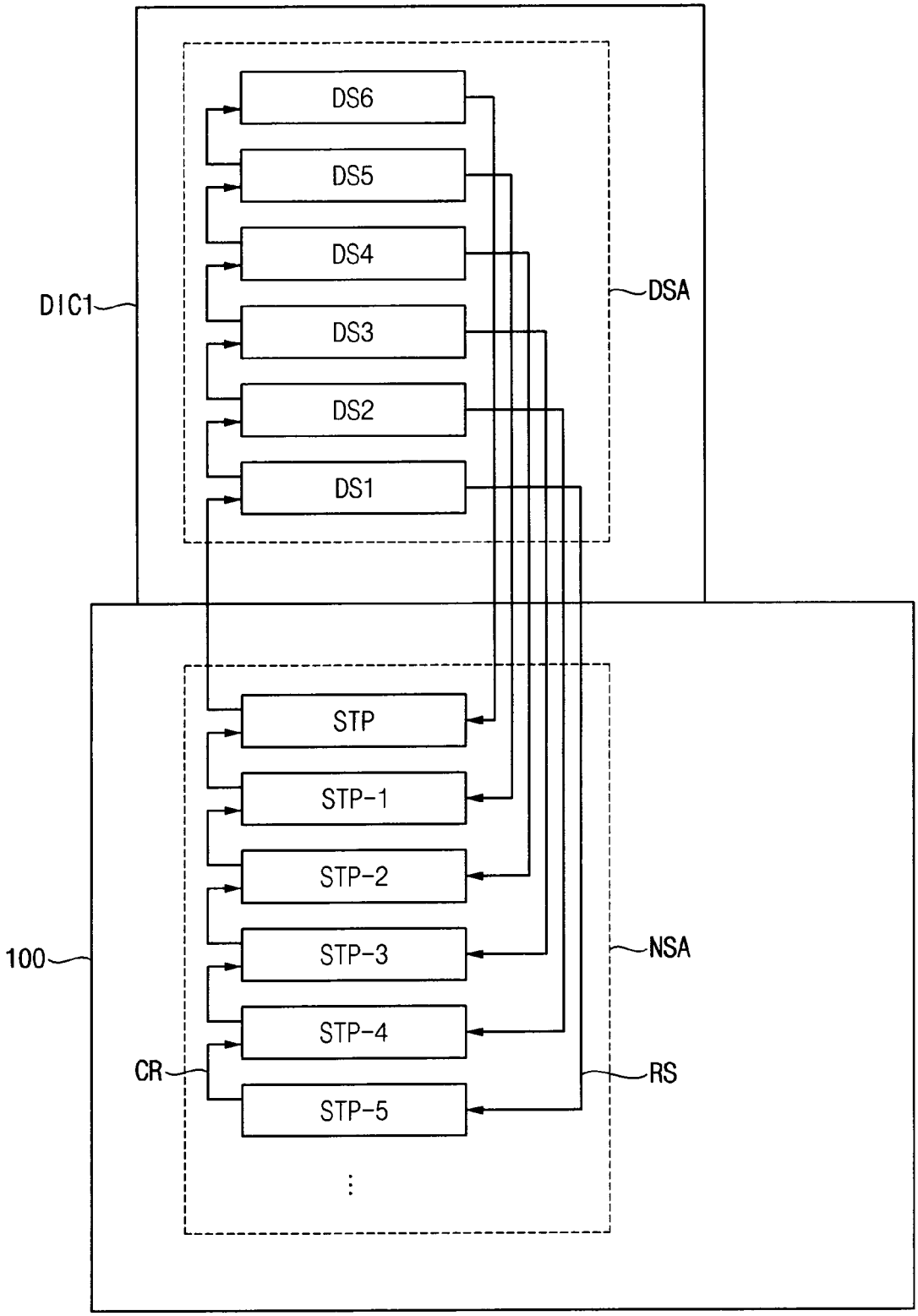
FIG. 7 is a diagram illustrating structures of normal stages disposed in the display panel of FIG. 3 and structures of dummy stages disposed in the data driver of FIG. 3.
Figure 8:
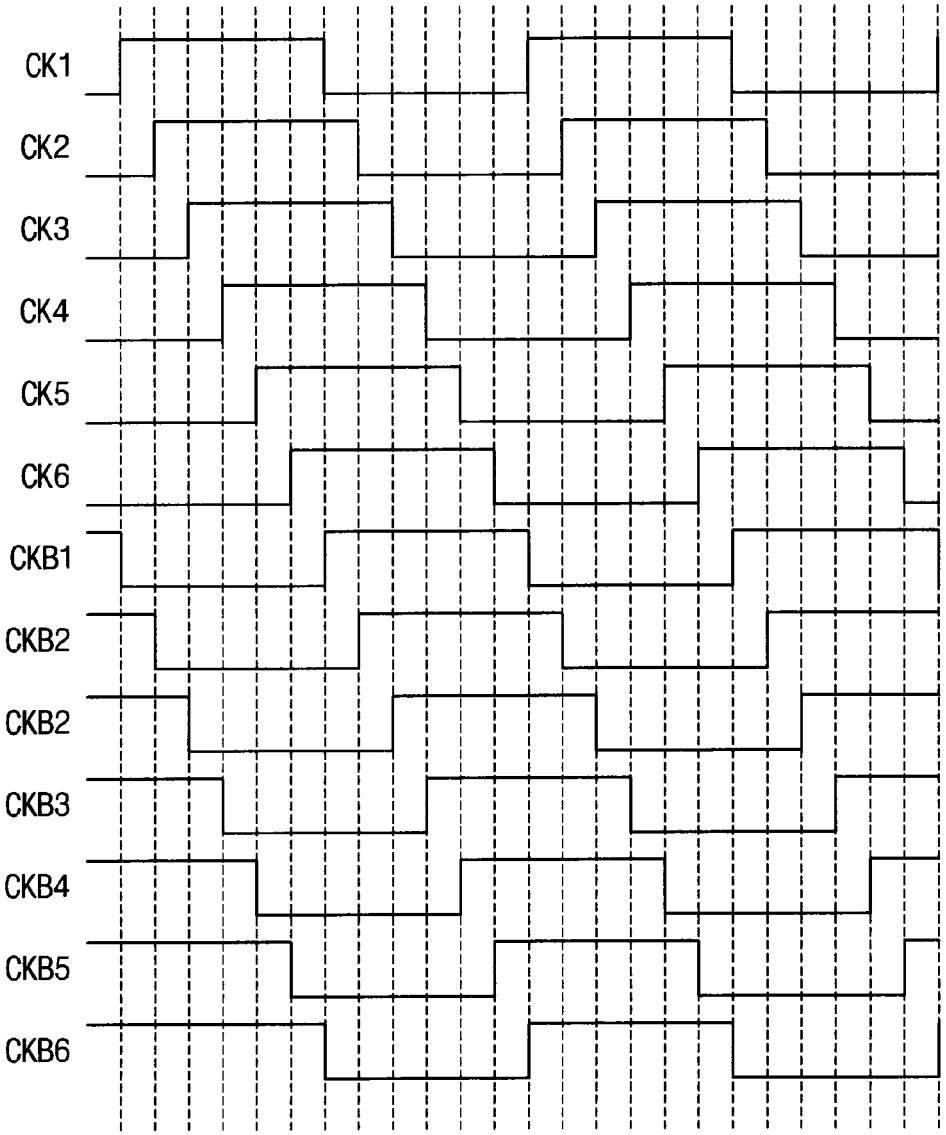
FIG. 8 is a waveform diagram illustrating clock signals applied to the normal stages of FIG. 5.

FIG. 7 is a diagram illustrating structures of normal stages disposed in the display panel 100 of FIG. 3 and structures of dummy stages disposed in the data driver 500 of FIG. 3. FIG. 8 is a waveform diagram illustrating clock signals applied to the normal stages of FIG. 5.

Referring to FIGS. 1 to 8, the normal stages (for example, STP-5, STP-4, STP-3, STP-2, STP-1 to STP) may output a carry signal CR to one of next stages and the normal stages may sequentially output the gate signals to the gate lines in response to the carry signal CR. The normal stages (for example, STP-5 to STP) may receive the reset signal RS from one of the next stages and may pull down a level of the gate signal in response to the reset signal RS.

Previous stages of the normal stages may receive the reset signal RS from subsequent stages of the normal stages. However, last stages (for example, STP-5 to STP) of the normal stages do not have subsequent stages so that the last stages (for example, STP-5 to STP) of the normal stages may receive the reset signal RS from the dummy stages (for example, DS1, DS2, DS3, DS4, DS5 to DS6).

Although the last six stages of the normal stages receive the reset signals RS from six dummy stages in an embodiment, the disclosure is not limited thereto. For example, plural stages of the normal stages may receive the reset signals RS from plural dummy stages.

As shown in FIG. 8, for example, six clock signals CK1, CK2, CK3, CK4, CK5 and CK6 having different timings and six inverted clock signals CKB1, CKB2, CKB3, CKB4, CKB5 and CKB6 having inverted phases from the clock signals CK1, CK2, CK3, CK4, CK5 and CK6 may be applied to the stages of the gate driver 300.

For example, a first clock signal CK1 may be applied to a first normal stage. A second clock signal CK2 different from the first clock signal CK1 may be applied to a second normal stage adjacent to the first normal stage. A third clock signal CK3 different from the first clock signal CK1 and the second clock signal CK2 may be applied to a third normal stage adjacent to the second normal stage. A fourth clock signal CK4 different from the first clock signal CK1, the second clock signal CK2 and the third clock signal CK3 may be applied to a fourth normal stage adjacent to the third normal stage. A fifth clock signal CK5 different from the first to fourth clock signals CK1 to CK4 may be applied to a fifth normal stage adjacent to the fourth normal stage. A sixth clock signal CK6 different from the first to fifth clock signals CK1 to CK5 may be applied to a sixth normal stage adjacent to the fifth normal stage.

Although the twelve clock signals having different timings are applied to the stages in an embodiment for convenience of explanation, the disclosure is not limited thereto. By way of example, eight clock signals having different timings may be applied to the stages. By way of example, six clock signals having different timings may be applied to the stages. By way of example, four clock signals having different timings may be applied to the stages.

According to an embodiment, the normal stages of the gate driving circuit 300 may be disposed in the display area of the display panel 100 and the dummy stages outputting the reset signals RS to the normal stages may be disposed in the data driver 500 so that the dead space of the display apparatus may be reduced.

The width of the seam line corresponding to an area in which the plural display apparatuses may be connected may be reduced so that the display quality of the display system may be enhanced.

Figure 9:
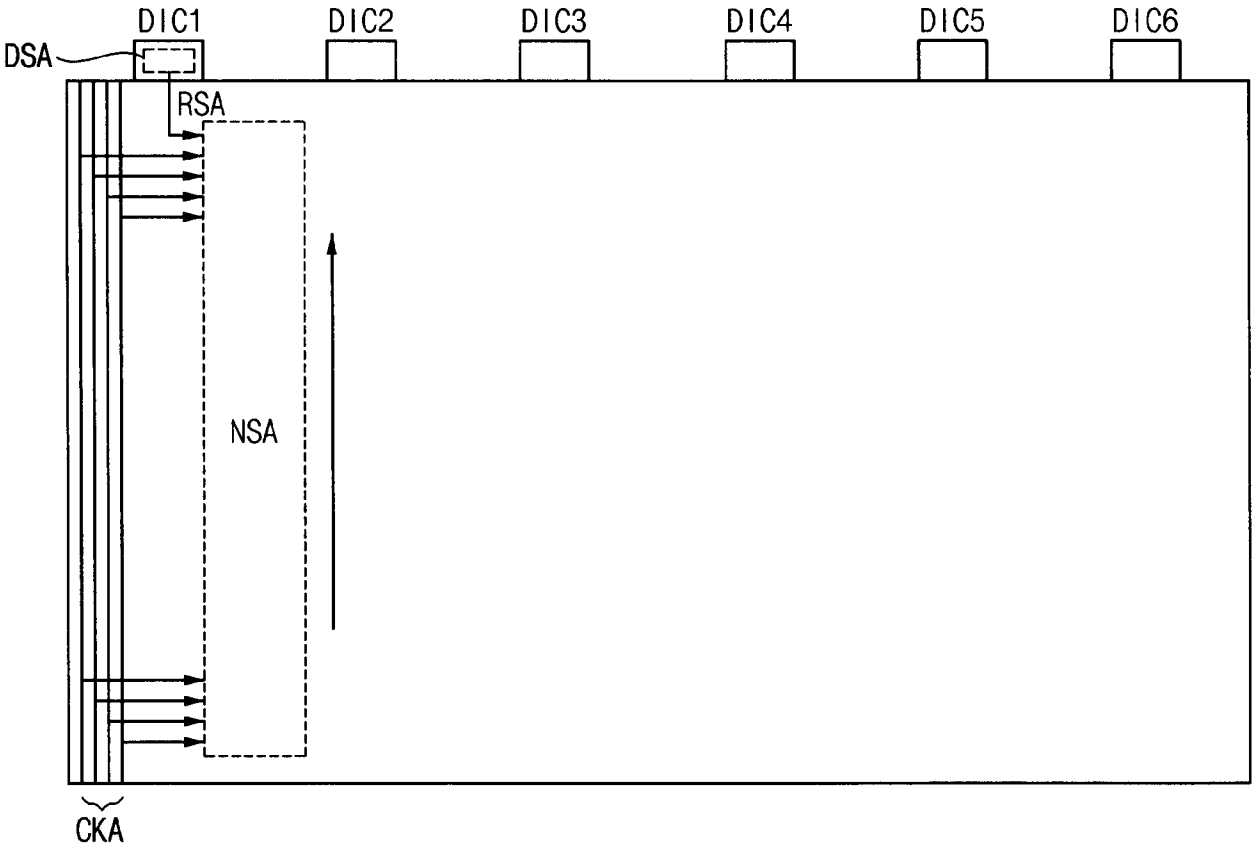
FIG. 9 is a plan view illustrating a normal stage column disposed in a display panel of a display apparatus according to an embodiment and a dummy stage column disposed in a data driver of the display apparatus.

FIG. 9 is a plan view illustrating a normal stage column disposed in a display panel of a display apparatus according to an embodiment and a dummy stage column disposed in a data driver of the display apparatus.

The display system according to an embodiment is substantially the same as the display system of the previous embodiment explained referring to FIGS. 1 to 8 except that one normal stage column may be disposed in the display panel and one dummy stage column may be formed in the data driving chip. Thus, the same reference numerals will be used to refer to the same or like parts as those described in the previous embodiment of FIGS. 1 to 8 and any repetitive explanation concerning the above elements may be omitted.

Referring to FIGS. 1 to 4 and 6 to 9, the display system may include a plurality of display apparatuses 1000A, 1000B, 1000C and 1000D connected to each other.

Each of the display apparatuses 1000A, 1000B, 1000C and 1000D may include a display panel 100 displaying an image and including a plurality of pixels P, a data driver 500 applying a data voltage to a data line DL of the display panel 100 and a gate driver 300 applying a gate signal to a gate line GL of the display panel 100. The gate driver 300 may be disposed between opening portions in the display area of the display panel 100. In an embodiment, the gate driver 300 may be also referred as a gate driving circuit.

For example, the gate driving circuit 300 may include the normal stage column NSA extending in a pixel column direction D2 of the display panel 100 and including a plurality of normal stages.

In an embodiment, a plurality of dummy stages may be disposed in the data driver 500. The dummy stage may output a reset signal RSA to at least one of the normal stages.

For example, the gate driving circuit 300 may include one normal stage column NSA. One dummy stage column DSA corresponding to the normal stage column NSA may be disposed in the data driving chip (for example, DIC1) of the data driver 500. The normal stage column may include the normal stages. The dummy stage column may include the dummy stages.

According to an embodiment, the normal stages of the gate driving circuit 300 may be disposed in the display area of the display panel 100 and the dummy stages outputting the reset signals RS to the normal stages may be disposed in the data driver 500 so that the dead space of the display apparatus may be reduced.

The width of the seam line corresponding to an area in which the plural display apparatuses may be connected may be reduced so that the display quality of the display system may be enhanced.

Figure 10:
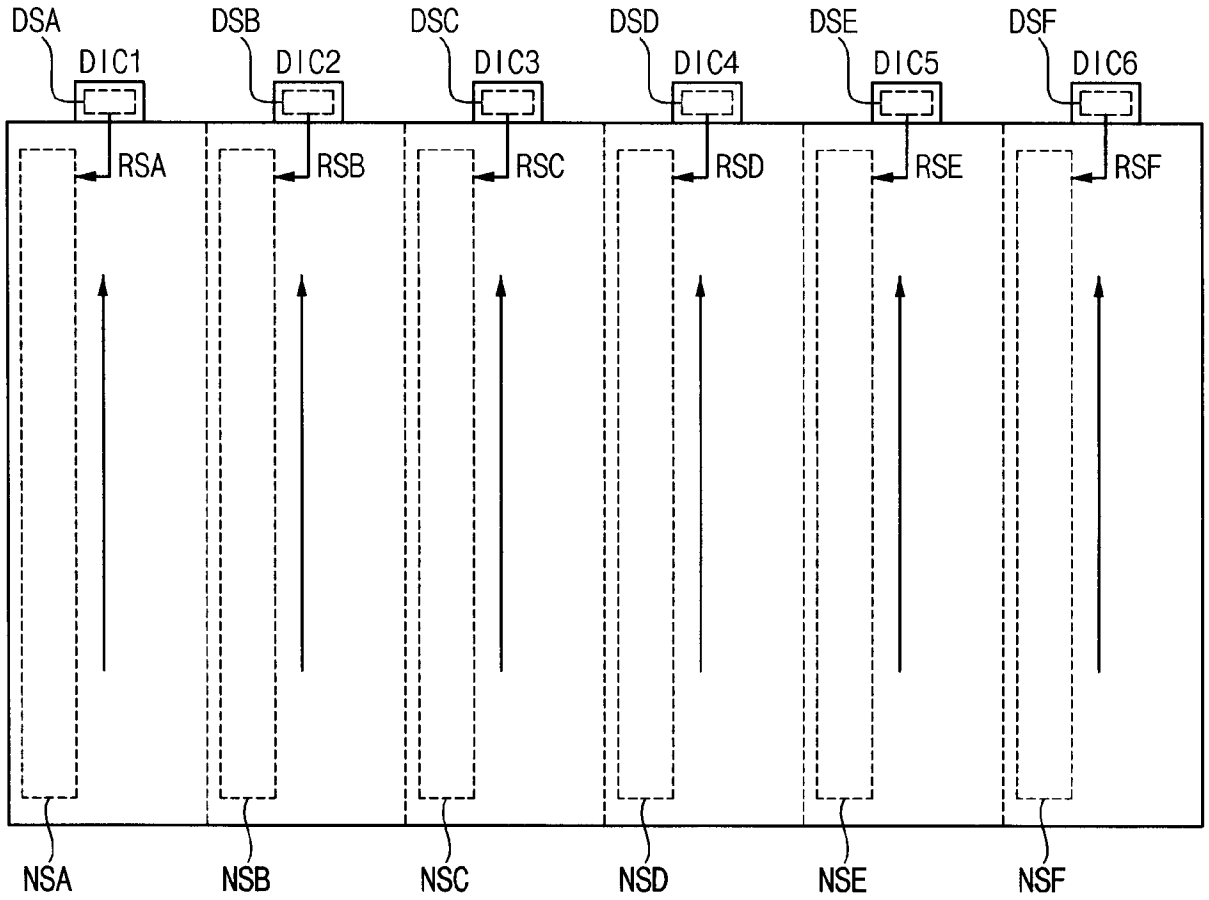
FIG. 10 is a plan view illustrating a normal stage column disposed in a display panel of a display apparatus according to an embodiment and a dummy stage column disposed in a data driver of the display apparatus.

FIG. 10 is a plan view illustrating a normal stage column disposed in a display panel of a display apparatus according to an embodiment and a dummy stage column disposed in a data driver of the display apparatus.

The display system according to an embodiment is substantially the same as the display system of the previous embodiment explained referring to FIGS. 1 to 8 except that the number of the normal stage columns formed in the display panel is same as the number of the data driving chip and one dummy stage column is formed in each of the data driving chips. Thus, the same reference numerals will be used to refer to the same or like parts as those described in the previous embodiment of FIGS. 1 to 8 and any repetitive explanation concerning the above elements may be omitted.

Referring to FIGS. 1 to 4, 6 to 8 and 10, the display system may include a plurality of display apparatuses 1000A, 1000B, 1000C and 1000D connected to each other.

Each of the display apparatuses 1000A, 1000B, 1000C and 1000D may include a display panel 100 displaying an image and including a plurality of pixels P, a data driver 500 applying a data voltage to a data line DL of the display panel 100 and a gate driver 300 applying a gate signal to a gate line GL of the display panel 100. The gate driver 300 may be disposed between opening portions in the display area of the display panel 100. In an embodiment, the gate driver 300 may be also referred as a gate driving circuit.

For example, the gate driving circuit 300 may include the normal stage columns NSA, NSB, NSC, NSD, NSE and NSF extending in a pixel column direction D2 of the display panel 100. Each of the normal stage columns NSA, NSB, NSC, NSD, NSE and NSF may include a plurality of normal stages.

In an embodiment, a plurality of dummy stages may be disposed in the data driver 500. The dummy stage may output a reset signal RSA, RSB, RSC, RSD, RSE and RSF to at least one of the normal stages.

For example, the gate driving circuit 300 may include a plurality of normal stage columns NSA, NSB, NSC, NSD, NSE and NSF. The dummy stage columns DSA, DSB, DSC, DSD, DSE and DSF corresponding to the normal stage columns NSA, NSB, NSC, NSD, NSE and NSF may be disposed in the data driving chips (for example, DIC1, DIC2, DIC3, DIC4, DIC5 and DIC6) of the data driver 500. The normal stage column may include the normal stages. The dummy stage column may include the dummy stages.

In an embodiment, the number (for example, six) of the dummy stage columns may be same as the number (for example, six) of the normal stage columns. The number of the data driving chips (for example, six) may be same as the number (for example, six) of the dummy stage columns.

According to an embodiment, the normal stages of the gate driving circuit 300 may be disposed in the display area of the display panel 100 and the dummy stages outputting the reset signals RS to the normal stages may be disposed in the data driver 500 so that the dead space of the display apparatus may be reduced.

The width of the seam line corresponding to an area in which the plural display apparatuses may be electrically connected may be reduced so that the display quality of the display system may be enhanced.

Figure 11:
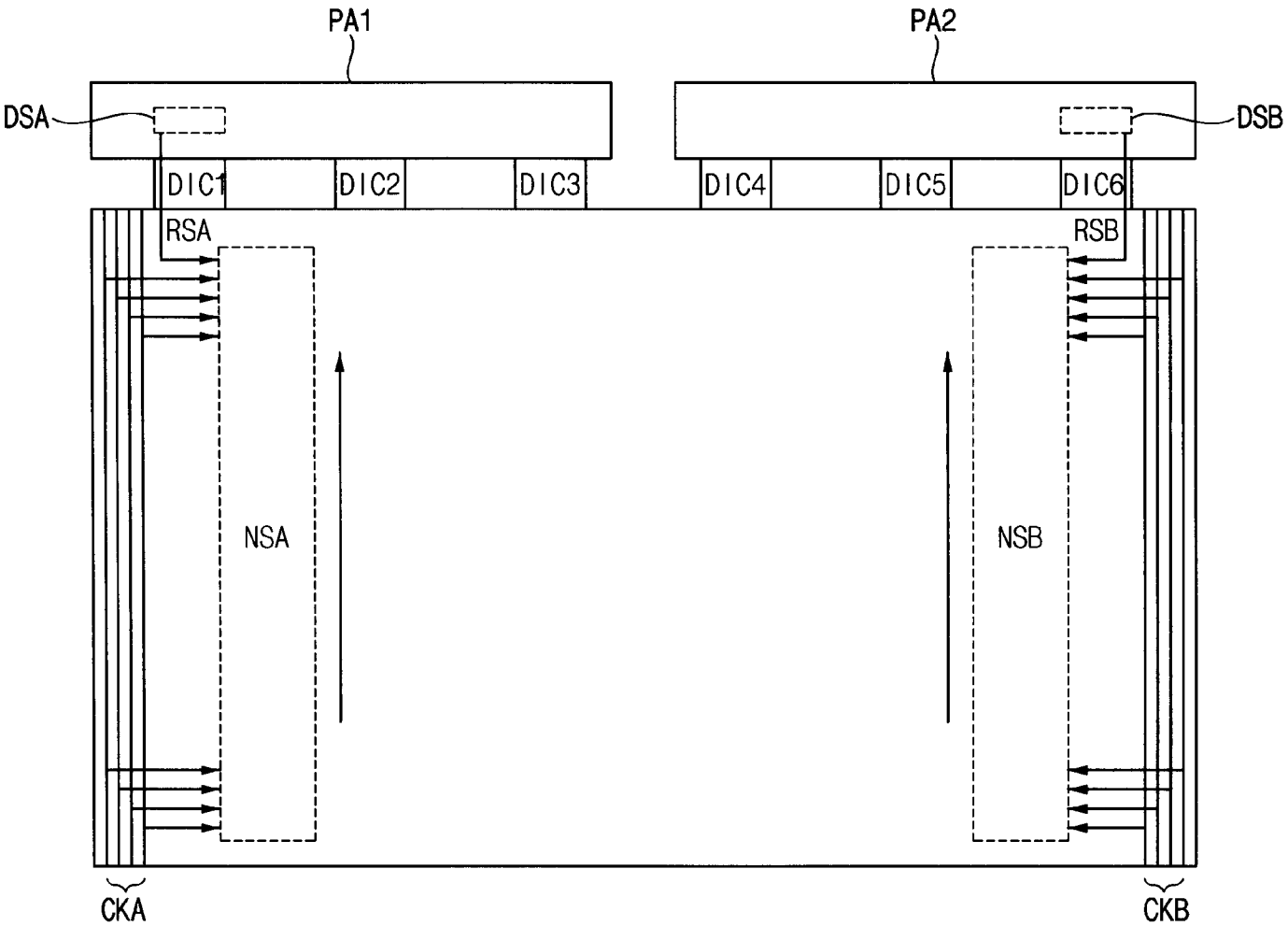
FIG. 11 is a plan view illustrating a normal stage column disposed in a display panel of a display apparatus according to an embodiment and a dummy stage column disposed on a printed circuit board of the display apparatus.

FIG. 11 is a plan view illustrating a normal stage column disposed in a display panel of a display apparatus according to an embodiment and a dummy stage column disposed on a printed circuit board of the display apparatus.

The display system according to an embodiment is substantially the same as the display system of the previous embodiment explained referring to FIGS. 1 to 8 except that the dummy stages are disposed on the printed circuit board. Thus, the same reference numerals will be used to refer to the same or like parts as those described in the previous embodiment of FIGS. 1 to 8 and any repetitive explanation concerning the above elements may be omitted.

Referring to FIGS. 1 to 4, 6 to 8 and 11, the display system may include a plurality of display apparatuses 1000A, 1000B, 1000C and 1000D connected to each other.

Each of the display apparatuses 1000A, 1000B, 1000C and 1000D may include a display panel 100 displaying an image and including a plurality of pixels P, a data driver 500 applying a data voltage to a data line DL of the display panel 100 and a gate driver 300 applying a gate signal to a gate line GL of the display panel 100. The gate driver 300 may be disposed between opening portions in the display area of the display panel 100. In an embodiment, the gate driver 300 may be also referred as a gate driving circuit.

For example, the gate driving circuit 300 may include the normal stage columns NSA and NSB extending in a pixel column direction D2 of the display panel 100. Each of the normal stage columns NSA and NSB may include a plurality of normal stages.

In an embodiment, a plurality of dummy stages may be disposed on the printed circuit board PA1 and PA2. The dummy stage may output a reset signal RSA and RSB to at least one of the normal stages.

For example, the gate driving circuit 300 may include a plurality of normal stage columns NSA and NSB. The dummy stage columns DSA and DSB corresponding to the normal stage columns NSA and NSB may be respectively disposed on the printed circuit board PA1 and PA2. The normal stage column may include the normal stages. The dummy stage column may include the dummy stages.

In an embodiment, the number (for example, two) of the dummy stage columns may be same as the number (for example, two) of the normal stage columns. The number of the data driving chips (for example, six) may be greater than the number (for example, two) of the dummy stage columns.

According to an embodiment, the normal stages of the gate driving circuit 300 may be disposed in the display area of the display panel 100 and the dummy stages outputting the reset signals RS to the normal stages may be disposed on the printed circuit board PA1 and PA2 so that the dead space of the display apparatus may be reduced.

The width of the seam line corresponding to an area in which the plural display apparatuses may be connected may be reduced so that the display quality of the display system may be enhanced.

Figure 12:
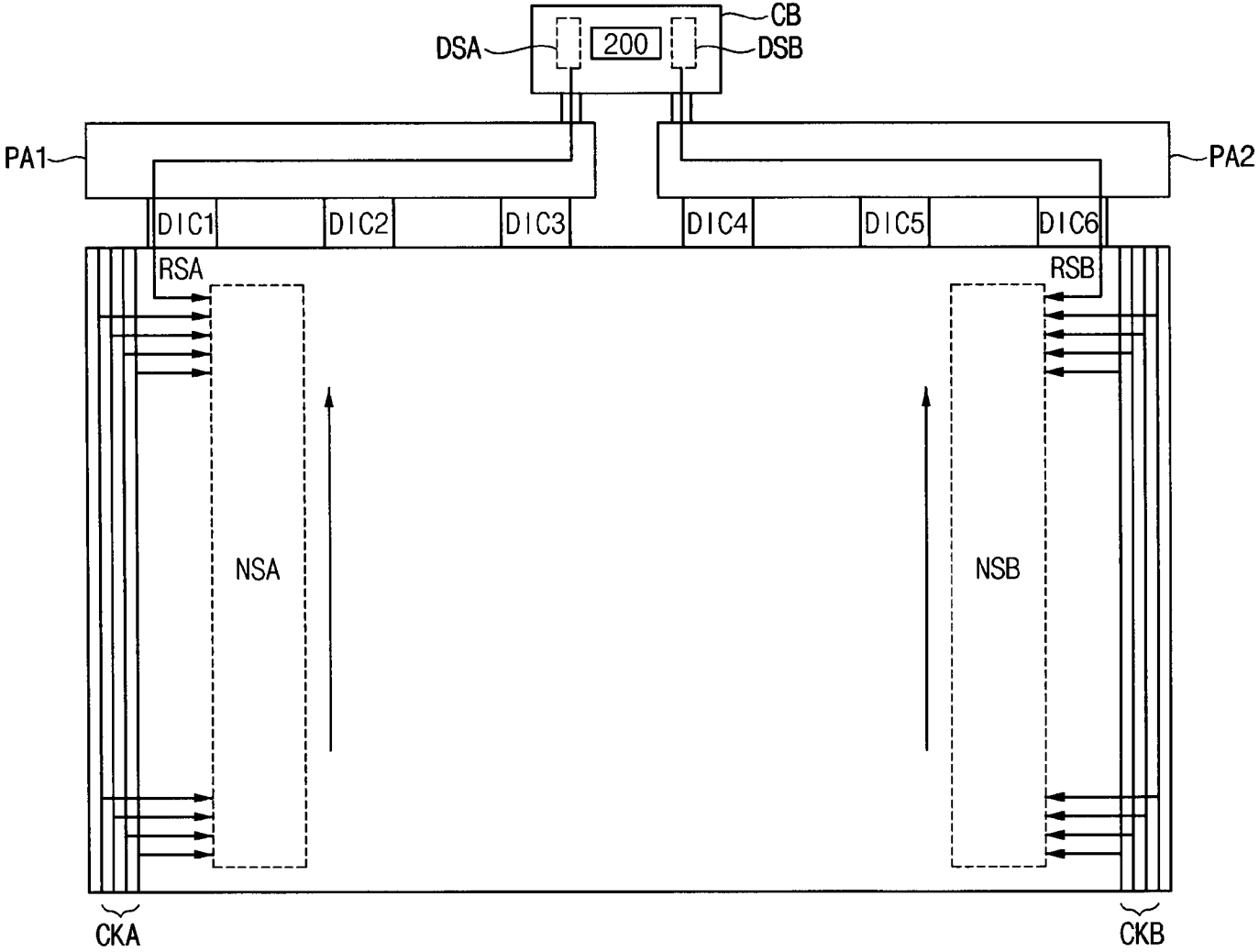
FIG. 12 is a plan view illustrating a normal stage column disposed in a display panel of a display apparatus according to an embodiment and a dummy stage column disposed on a control board of the display apparatus.

FIG. 12 is a plan view illustrating a normal stage column disposed in a display panel of a display apparatus according to an embodiment and a dummy stage column disposed on a control board of the display apparatus.

The display system according to an embodiment is substantially the same as the display system of the previous embodiment explained referring to FIGS. 1 to 8 except that the dummy stages are disposed on the control board. Thus, the same reference numerals will be used to refer to the same or like parts as those described in the previous embodiment of FIGS. 1 to 8 and any repetitive explanation concerning the above elements may be omitted.

Referring to FIGS. 1 to 4, 6 to 8 and 12, the display system may include a plurality of display apparatuses 1000A, 1000B, 1000C and 1000D connected to each other.

Each of the display apparatuses 1000A, 1000B, 1000C and 1000D may include a display panel 100 displaying an image and including a plurality of pixels P, a data driver 500 applying a data voltage to a data line DL of the display panel 100 and a gate driver 300 applying a gate signal to a gate line GL of the display panel 100. The gate driver 300 may be disposed between opening portions in the display area of the display panel 100. In an embodiment, the gate driver 300 may be also referred as a gate driving circuit.

For example, the gate driving circuit 300 may include the normal stage columns NSA and NSB extending in a pixel column direction D2 of the display panel 100. Each of the normal stage columns NSA and NSB may include a plurality of normal stages.

In an embodiment, a plurality of dummy stages may be disposed on the control board CB. The dummy stage may output a reset signal RSA and RSB to at least one of the normal stages.

For example, the gate driving circuit 300 may include a plurality of normal stage columns NSA and NSB. The dummy stage columns DSA and DSB corresponding to the normal stage columns NSA and NSB may be disposed on the control board CB. The normal stage column may include the normal stages. The dummy stage column may include the dummy stages.

In an embodiment, the number (for example, two) of the dummy stage columns may be same as the number (for example, two) of the normal stage columns. The number of the data driving chips (for example, six) may be greater than the number (for example, two) of the dummy stage columns.

According to an embodiment, the normal stages of the gate driving circuit 300 may be disposed in the display area of the display panel 100 and the dummy stages outputting the reset signals RS to the normal stages may be disposed on the control board CB so that the dead space of the display apparatus may be reduced.

The width of the seam line corresponding to an area in which the plural display apparatuses may be connected may be reduced so that the display quality of the display system may be enhanced.

Figure 13:
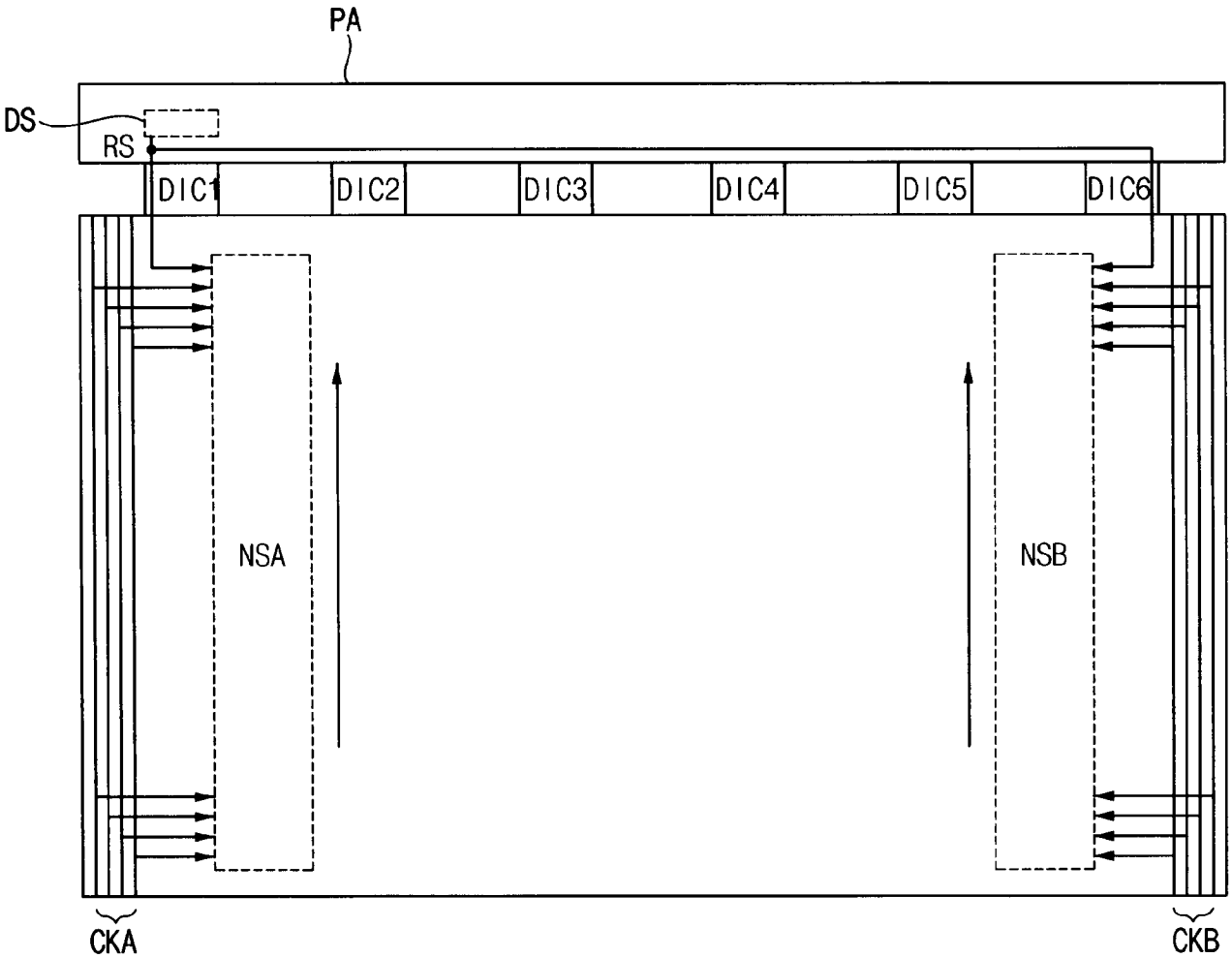
FIG. 13 is a plan view illustrating a normal stage column disposed in a display panel of a display apparatus according to an embodiment and a dummy stage column disposed on a printed circuit board of the display apparatus.
Figure 14:
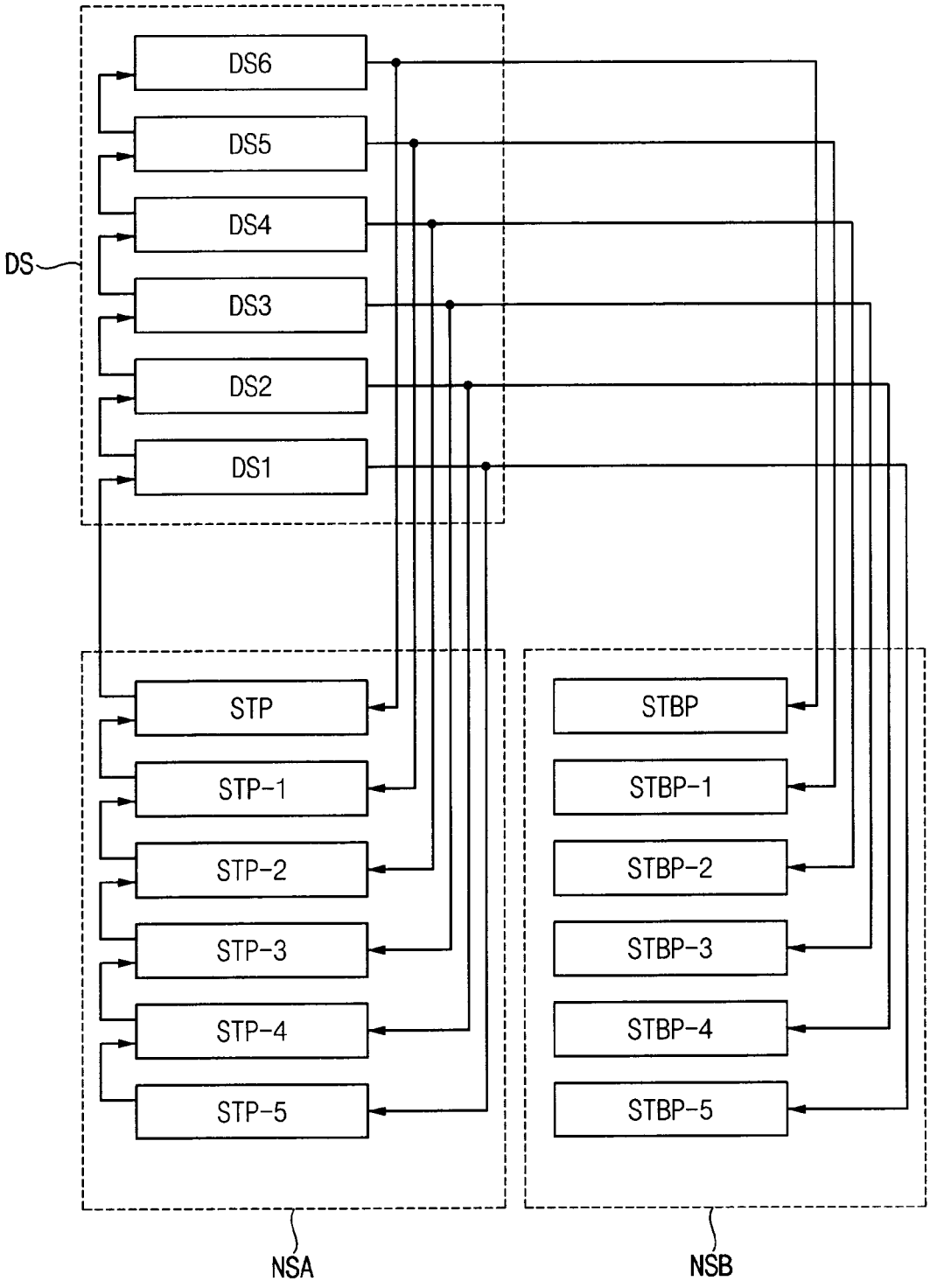
FIG. 14 is a diagram illustrating structures of normal stages disposed in the display panel of FIG. 13 and structures of dummy stages disposed on the printed circuit board of FIG. 13.

FIG. 13 is a plan view illustrating a normal stage column NSA and NSB disposed in a display panel 100 of a display apparatus according to an embodiment and a dummy stage column disposed on a printed circuit board PA of the display apparatus. FIG. 14 is a diagram illustrating structures of normal stages disposed in the display panel 100 of FIG. 13 and structures of dummy stages disposed on the printed circuit board PA of FIG. 13.

In an embodiment, the gate driving circuit 300 may include a plurality of normal stage columns NSA and NSB. One dummy stage column DS corresponding to the normal stage columns NSA and NSB may be disposed on the printed circuit board PA. The dummy stage column DS may output the reset signal RS to the normal stage columns NSA and NSB.

The dummy stage column DS may receive a carry signal from one (for example, NSA) of the normal stage columns NSA and NSB and may output the reset signal RS to both the normal stage columns NSA and NSB.

According to an embodiment, the normal stages of the gate driving circuit 300 may be disposed in the display area of the display panel 100 and the dummy stages outputting the reset signals RS to the normal stages may be disposed on the printed circuit board PA so that the dead space of the display apparatus may be reduced.

The width of the seam line corresponding to an area in which the plural display apparatuses may be connected may be reduced so that the display quality of the display system may be enhanced.

Figure 15:
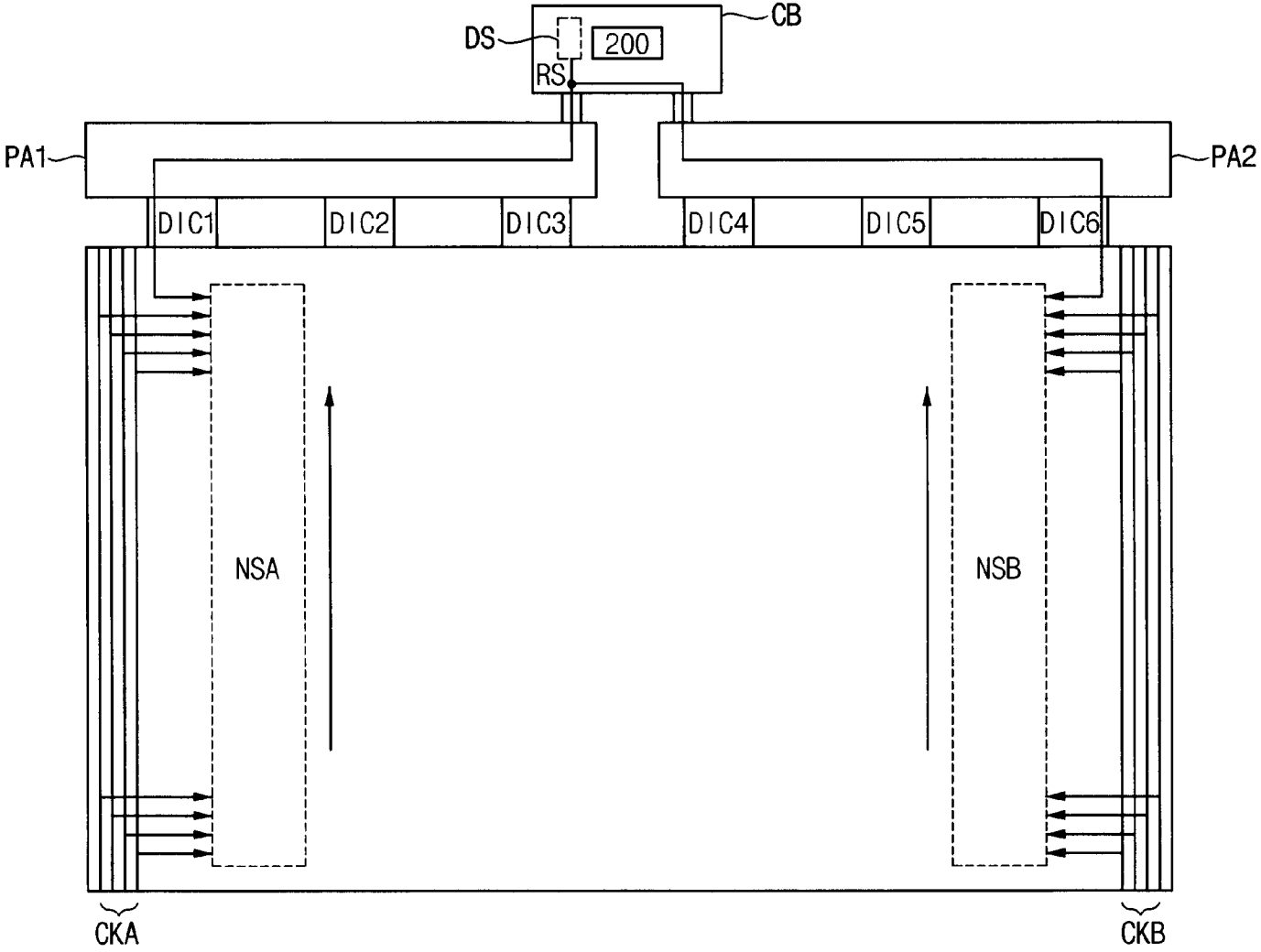
FIG. 15 is a plan view illustrating a normal stage column disposed in a display panel of a display apparatus according to an embodiment and a dummy stage column disposed on a control board of the display apparatus.

FIG. 15 is a plan view illustrating a normal stage column NSA and NSB disposed in a display panel 100 of a display apparatus according to an embodiment and a dummy stage column DS disposed on a control board CB of the display apparatus.

In an embodiment, the gate driving circuit 300 may include a plurality of normal stage columns NSA and NSB. One dummy stage column DS corresponding to the normal stage columns NSA and NSB may be disposed on the control board CB. The dummy stage column DS may output the reset signal RS to the normal stage columns NSA and NSB.

The dummy stage column DS may receive a carry signal from one (for example, NSA) of the normal stage columns NSA and NSB and may output the reset signal RS to both the normal stage columns NSA and NSB.

According to an embodiment, the normal stages of the gate driving circuit 300 may be disposed in the display area of the display panel 100 and the dummy stages outputting the reset signals RS to the normal stages may be disposed on the control board CB so that the dead space of the display apparatus may be reduced.

The width of the seam line corresponding to an area in which the plural display apparatuses may be connected may be reduced so that the display quality of the display system may be enhanced.

According to the display apparatus and the display system as explained above, the dead space of the display system may be reduced.

The foregoing is illustrative and is not to be construed as limiting thereof. Although embodiments have been described, those skilled in the art will readily appreciate that many modifications are possible in the embodiments without materially departing from the novel teachings and advantages of the disclosure. Accordingly, all such modifications are intended to be included within the scope of the disclosure as defined in the claims. The claims may include functional clauses that are intended to be directed to the structures described herein as performing the recited function and not only structural equivalents but also equivalent structures. Therefore, it is to be understood that the foregoing is illustrative and is not to be construed as limited to the embodiments disclosed, and that modifications to the disclosed embodiments, as well as other embodiments, are intended to be included within the scope of the disclosure and the appended claims. The disclosure may therefore be defined by the following claims, with equivalents of the claims to be included therein.

What is claimed is:

1. A display apparatus comprising:

a display panel comprising a plurality of pixels, a plurality of data lines, and a plurality of gate lines;

a data driver that applies a plurality of data voltages to the plurality of data lines, the data driver includes a plurality of dummy stages; and a gate driving circuit that applies a plurality of gate signals to the plurality of gate lines, the gate driving circuit being disposed between opening portions in a display area of the display panel, wherein the gate driving circuit includes a plurality of normal stages that output the plurality of gate signals to the plurality of gate lines, and the plurality of dummy stages output a reset signal to at least one of the plurality of normal stages.

2. The display apparatus of claim 1, wherein the data driver is electrically connected to the display panel at a first side of the display panel.

3. The display apparatus of claim 2, wherein the plurality of normal stages are scanned from a second side of the display panel to the first side of the display panel, and the first side and the second side of the display panel are opposite to each other.

4. The display apparatus of claim 1, wherein one normal stage of the plurality of normal stages outputs a gate signal of the plurality of gate signals to one pixel row, and the one normal stage is disposed at an area corresponding to a plurality of pixel columns.

5. The display apparatus of claim 1, wherein the gate driving circuit includes one normal stage column, one dummy stage column corresponding to the one normal stage column is disposed in a data driving chip of the data driver, the one normal stage column includes the plurality of normal stages, and the one dummy stage column includes the plurality of dummy stages.

6. The display apparatus of claim 1, wherein the gate driving circuit includes a plurality of normal stage columns, a plurality of dummy stage columns corresponding to the plurality of normal stage columns are disposed in a plurality of data driving chips of the data driver, the plurality of normal stage columns include the plurality of normal stages, and the plurality of dummy stage columns include the plurality of dummy stages.

7. The display apparatus of claim 6, wherein a number of the plurality of dummy stage columns is same as a number of the plurality of normal stage columns, and a number of the plurality of data driving chips is same as the number of the plurality of dummy stage columns.

8. A display apparatus comprising:

a display panel including a plurality of pixels, a plurality of data lines, and a plurality of gate lines;

a data driver comprising a plurality of data driving chips that apply a plurality of data voltages to the plurality of data lines;

a gate driving circuit that applies a plurality of gate signals to the plurality of gate lines, the gate driving circuit being disposed between opening portions in a display area of the display panel; and a printed circuit board electrically connected to the plurality of data driving chips, the printed circuit board including a plurality of dummy stages, wherein the gate driving circuit comprises a plurality of normal stages that output the plurality of gate signals to the plurality of gate lines, and the plurality of dummy stages output a reset signal to at least one of the plurality of normal stages.

9. The display apparatus of claim 8, wherein the plurality of data driving chips are electrically connected to the display panel at a first side of the display panel, the plurality of normal stages are scanned from a second side of the display panel to the first side of the display panel, and the first side and the second side of the display panel are opposite to each other.

10. The display apparatus of claim 8, wherein the gate driving circuit includes a plurality of normal stage columns, a plurality of dummy stage columns corresponding to the plurality of normal stage columns are disposed on the printed circuit board, the plurality of normal stage columns include the plurality of normal stages, and the plurality of dummy stage columns include the plurality of dummy stages.

11. The display apparatus of claim 10, wherein a number of the plurality of dummy stage columns is same as a number of the plurality of normal stage columns.

12. The display apparatus of claim 8, wherein the gate driving circuit includes a plurality of normal stage columns, and one dummy stage column outputs the reset signal to the plurality of normal stage columns and is disposed on the printed circuit board.

13. The display apparatus of claim 12, wherein the one dummy stage column receives a carry signal from one normal stage column of the plurality of normal stage columns, and the one dummy stage column outputs the reset signal to the plurality of normal stage columns.

14. A display apparatus comprising:

a display panel including a plurality of pixels, a plurality of data lines, and a plurality of gate lines;

a data driver comprising a plurality of data driving chips that apply a plurality of data voltages to the plurality of data lines;

a gate driving circuit that applies a plurality of gate signals to the plurality of gate lines, the gate driving circuit being disposed between opening portions in a display area of the display panel;

a driving controller that outputs a control signal to the data driver and the gate driving circuit;

a printed circuit board electrically connected to the plurality of data driving chips; and a control board electrically connected to the printed circuit board, the control board including a plurality of dummy stages, wherein the driving controller is disposed on the control board, the gate driving circuit comprises a plurality of normal stages that output the plurality of gate signals to the plurality of gate lines, and the plurality of dummy stages output a reset signal to at least one of the plurality of normal stages.

15. The display apparatus of claim 14, wherein the plurality of data driving chips are electrically connected to the display panel at a first side of the display panel, the plurality of normal stages are scanned from a second side of the display panel to the first side of the display panel, and the first side and the second side of the display panel are opposite to each other.

16. The display apparatus of claim 14, wherein the gate driving circuit includes a plurality of normal stage columns, a plurality of dummy stage columns corresponding to the plurality of normal stage columns are disposed on the control board, the plurality of normal stage columns include the plurality of normal stages, and the plurality of dummy stage columns include the plurality of dummy stages.

17. The display apparatus of claim 16, wherein a number of the plurality of dummy stage columns is same as a number of the plurality of normal stage columns.

18. The display apparatus of claim 14, wherein the gate driving circuit includes a plurality of normal stage columns, and one dummy stage column outputs the reset signal to the plurality of normal stage columns and is disposed on the control board.

19. The display apparatus of claim 18, wherein the one dummy stage column receives a carry signal from one normal stage column of the plurality of normal stage columns, and the one dummy stage column outputs the reset signal to the plurality of normal stage columns.

20. A display system comprising:

a plurality of display apparatuses connected to each other, wherein each of the plurality of display apparatuses comprises:

a display panel comprising a plurality of pixels, a plurality of data lines, and a plurality of gate lines;

a data driver that applies a plurality of data voltages to the plurality of data lines, the data driver including a plurality of dummy stages; and a gate driving circuit that applies a plurality of gate signals to the plurality of gate lines, the gate driving circuit being disposed between opening portions in a display area of the display panel, wherein the gate driving circuit includes a plurality of normal stages that output the plurality of gate signals to the plurality of gate lines, and the plurality of dummy stages output a reset signal to at least one of the plurality of normal stages.

* * * * *